US008419017B1

(12) United States Patent
Lazare

(10) Patent No.: US 8,419,017 B1
(45) Date of Patent: Apr. 16, 2013

(54) KING OF THE MOUNTAIN BOARD GAME

(76) Inventor: Joel E. Lazare, Houston, TX (US)

( * ) Notice: Subject to any disclaimer, the term of this patent is extended or adjusted under 35 U.S.C. 154(b) by 0 days.

(21) Appl. No.: 13/372,548

(22) Filed: Feb. 14, 2012

(51) Int. Cl.
*A63F 3/00* (2006.01)

(52) U.S. Cl.
USPC ..... 273/241; 273/287

(58) Field of Classification Search ..... 273/241, 273/287, 285
See application file for complete search history.

(56) References Cited

U.S. PATENT DOCUMENTS

| | | | | | |
|---|---|---|---|---|---|
| 2,128,608 | A | * | 8/1938 | Goertemiller | 273/251 |
| 2,729,451 | A | * | 1/1956 | Larson | 273/239 |
| 3,030,112 | A | * | 4/1962 | Scharp | 273/241 |
| 3,083,020 | A | * | 3/1963 | Terschak | 273/241 |
| 3,430,961 | A | * | 3/1969 | Burn | 273/250 |
| 3,792,865 | A | * | 2/1974 | Credico et al. | 273/258 |
| 3,941,385 | A | * | 3/1976 | Lalley | 273/242 |
| 4,019,742 | A | * | 4/1977 | Thompson | 273/246 |
| 4,062,545 | A | * | 12/1977 | Witney | 273/239 |
| 4,128,246 | A | * | 12/1978 | Hicks et al. | 273/243 |
| 4,205,851 | A | * | 6/1980 | Hopkins | 273/241 |
| 4,333,655 | A | * | 6/1982 | Rudell et al. | 273/241 |
| 4,477,080 | A | * | 10/1984 | Baker | 273/241 |
| 4,563,011 | A | * | 1/1986 | Ferris et al. | 273/243 |
| 4,955,618 | A | * | 9/1990 | Growall | 273/258 |
| 5,004,245 | A | * | 4/1991 | Schumacher et al. | 273/241 |
| 5,004,246 | A | * | 4/1991 | Merrill et al. | 273/246 |
| 5,129,655 | A | * | 7/1992 | Gillespie et al. | 273/241 |
| D390,885 | S | * | 2/1998 | Molnar | D21/360 |
| 6,203,017 | B1 | * | 3/2001 | Schultz | 273/285 |
| 6,837,493 | B1 | * | 1/2005 | Cotton et al. | 273/254 |

* cited by examiner

*Primary Examiner* — Vishu K. Mendiratta
(74) *Attorney, Agent, or Firm* — Kyle Fletcher

(57) ABSTRACT

The King of the Mountain board game includes a board game having a mountain located on a portion of the game board surface. The mountain is composed of differently numbered squares at varying tiers; whereas the remaining flat surface of the game board includes differently numbered squares ordered sequentially and up to the mountain. The board game is collapsible such that the mountain folds up and down before and after use. Rules of play are provided on a small portion of the game board. The game further includes uniquely characterized dice that when rolled, and accordingly to the rules of play, move a player's piece along the game board. The objective of the game is to be the first player to traverse the game board, and ascend to the top of the mountain, and pursuant to the rules of play.

14 Claims, 5 Drawing Sheets

104

GAME RULES

The objective of this game is to be the first one to make it to the top of the Mountain.

When you land on an animal you must follow these instructions:
Elephant = move forward to "18"
Horse = move forward to "38"
Lion = move back to "27"
Turtle = move back to "62"
Dolphin = move forward to "76"
Billy Goat = you must roll the dice again If you get two Billy Goats face up you send anyone of your opponents back to "1" and you move back to "81". But if you roll anything else you must move back to "1" and you can not send anyone back to "1".

ROLLING THE DICE

The only time you can use the Billy Goat located on dice is when you land on the Billy Goat "85" located on board game.
When rolling the dice you can only add the numbers together to make your move. If two "0" are rolled you lose your turn to move and the next player rolls.

ADDING ZERO WITH OTHER NUMBERS

| | | | |
|---|---|---|---|
| 0+1=1 | 1+1=2 | 2+1=3 | 3+1=4 |
| 0+2=2 | 1+2=3 | 2+2=4 | 3+2=5 |
| 0+3=3 | 1+3=4 | 2+3=5 | 3+3=6 |

1+0=1 not 10 2+0=2 not 20 3+0=3 not 30

KING OF THE MOUNTAIN

FIG. 5

KING OF THE MOUNTAIN BOARD GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of board games, more specifically, a unique board game derived from a King of the Mountain format.

B. Discussion of the Prior Art

As will be discussed immediately below, no prior art discloses a King of the Mountain stylized board game that involves dice with numbers and animals provided thereon such that upon rolling the dice, a player shall move to a particular location on the board game according to rules provided on the game rules card; wherein the game board can be erected and collapsed for use and storage purposes; wherein the game board features a mountain comprised of multiple tiers that have numbers thereon; and wherein the purpose of the game is for all players to traverse the numbered squares on the board game and highest numbered tier on the mountain wherein the first player to do deemed the winner of the King of the Mountain board game.

The Schultz Patent (U.S. Pat. No. 6,203,017) discloses a board game that includes a folding board having a plurality of generally planar board segments. However, the folding game board does not include a mountain including a plurality of numbered tiers that are ascended in order to win a "king of the mountain"-styled board game.

The Hopkins Patent (U.S. Pat. No. 4,205,851) discloses a game board incorporating a three-dimensional surface contour on the board while simultaneously being able to fold the board to eliminate the storage problem. However, the game board does not erect and collapse between uses and form a mountain comprised of various numbered tiers.

The Hicks et al. Patent (U.S. Pat. No. 4,128,246) discloses a board-type game apparatus designed around the theme of a mythical man-animal known as "Big Foot" having a game board having a relatively large elevated playing area. Again, the board game does not include a mountain on a portion of the game board that has multiple numbered squares at varying tiers thereon in which the objective for all players is to be the first player to ascend to the top of the mountain.

The Credico, Jr. et al. Patent (U.S. Pat. No. 3,792,865) discloses a game including a simulated mountain preferably formed of sectional parts to enable it to be easily packaged and shipped. However, the game board does not include a mountain composed of a plurality of differently numbered squares at varying tiers wherein the objective is to be the first player to ascend to the top of the mountain pursuant to rules particular to this game.

The Terschak Patent (U.S. Pat. No. 3,083,020) discloses a folding mountain game device. However, the folding mountain game does not feature a game board upon which a mountain is provided and composed of differently numbered squares arranged at varying tiers in which the objective is to be the first player to ascend the mountain according to rules particular to the game.

The Larson et al. Patent (U.S. Pat. No. 2,729,451) discloses a three dimensional board game using magnetic pieces. However, the board game does not include a flat playing surface along with a mountain that includes differently numbered squares at varying tiers in which the objective is to be the first player to ascend the mountain accordingly to the rules of play.

The Lalley Patent (U.S. Pat. No. 3,941,385) discloses a novel game apparatus and method of play that includes a game board and a number of pawns or player elements, certain of which are representative of forces of good and others of which are representative of forces of evil and which are selectively movable along or over the game board in order to achieve a predetermined game objective. Again, the novel game is not a king of the mountain themed game involving a unique game board that can erect and collapse between uses, and involving unique rides of play.

While the above-described devices fulfill their respective and particular objects and requirements, they do not describe a King of the Mountain stylized board game that involves dice with numbers and animals provided thereon such that upon rolling the dice, a player shall move to a particular location on the board game according to rules provided on the game rules card; wherein the game board can be erected and collapsed for use and storage purposes; wherein the game board features a mountain comprised of multiple tiers that have numbers thereon; and wherein the purpose of the game is for all players to/traverse the numbered squares on the board game and up the numbered tiers of the mountain before reaching the highest numbered tier on the mountain wherein the first player to do so is deemed the winner of the King of the Mountain board game. In this regard, the King of the Mountain board game departs from the conventional concepts and designs of the prior art.

SUMMARY OF THE INVENTION

The King of the Mountain board game includes a board game having a mountain located on a portion of the game board surface. The mountain is composed of differently numbered squares at varying tiers; whereas the remaining flat surface of the game board includes differently numbered squares ordered sequentially and up to the mountain. The board game is collapsible such that the mountain folds up and down before and after use. Rules of play are provided on a small portion of the game board. The game further includes uniquely characterized dice that when rolled, and accordingly to the rules of play, move a player's piece along the game board. The objective of the game is to be the first player to traverse the game board, and ascend to the top of the mountain, and pursuant to the rules of play.

An object of the invention is to provide a "king of the mountain"-stylized game that includes a game board with a mountain provided on a portion of the game board surface.

A further object of the invention is to provide a game board and mountain that can be erected and collapsed before and after use, respectively.

An even further object of the invention is to provide a mountain that includes differently numbered squares at varying tiers.

A further object of the invention is to provide a game wherein the objective is to be the first player to traverse along the game board and ascend to the top of the mountain.

An even further object of the invention is to provide dice that when rolled, and according to the rules of play, shall move a player's piece along the squares provided on both the flat game board surface and the mountain.

An even further object of the invention is to provide dice with different numbered squares or with a Billy goat that represent special movements along the differently numbered squares of both the flat game board surface as well as the mountain.

These together with additional objects, features and advantages of the King of the Mountain board game will be readily apparent to those of ordinary skill in the art upon reading the following detailed description of presently preferred, but nonetheless illustrative, embodiments of the King of the Mountain board game when taken in conjunction with the accompanying drawings.

In this respect, before explaining the current embodiments of the King of the Mountain board game in detail, it is to be understood that the King of the Mountain board game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the King of the Mountain board game.

It is therefore important that the claims be regarded as including such equivalent construction insofar as they do not depart from the spirit and scope of the King of the Mountain board game. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 5 illustrates a game rules card that is provided on the game board, which briefly provides the general rules of play used to play the King of the Mountain board game.

DETAILED DESCRIPTION OF THE EMBODIMENT

Figure 1:
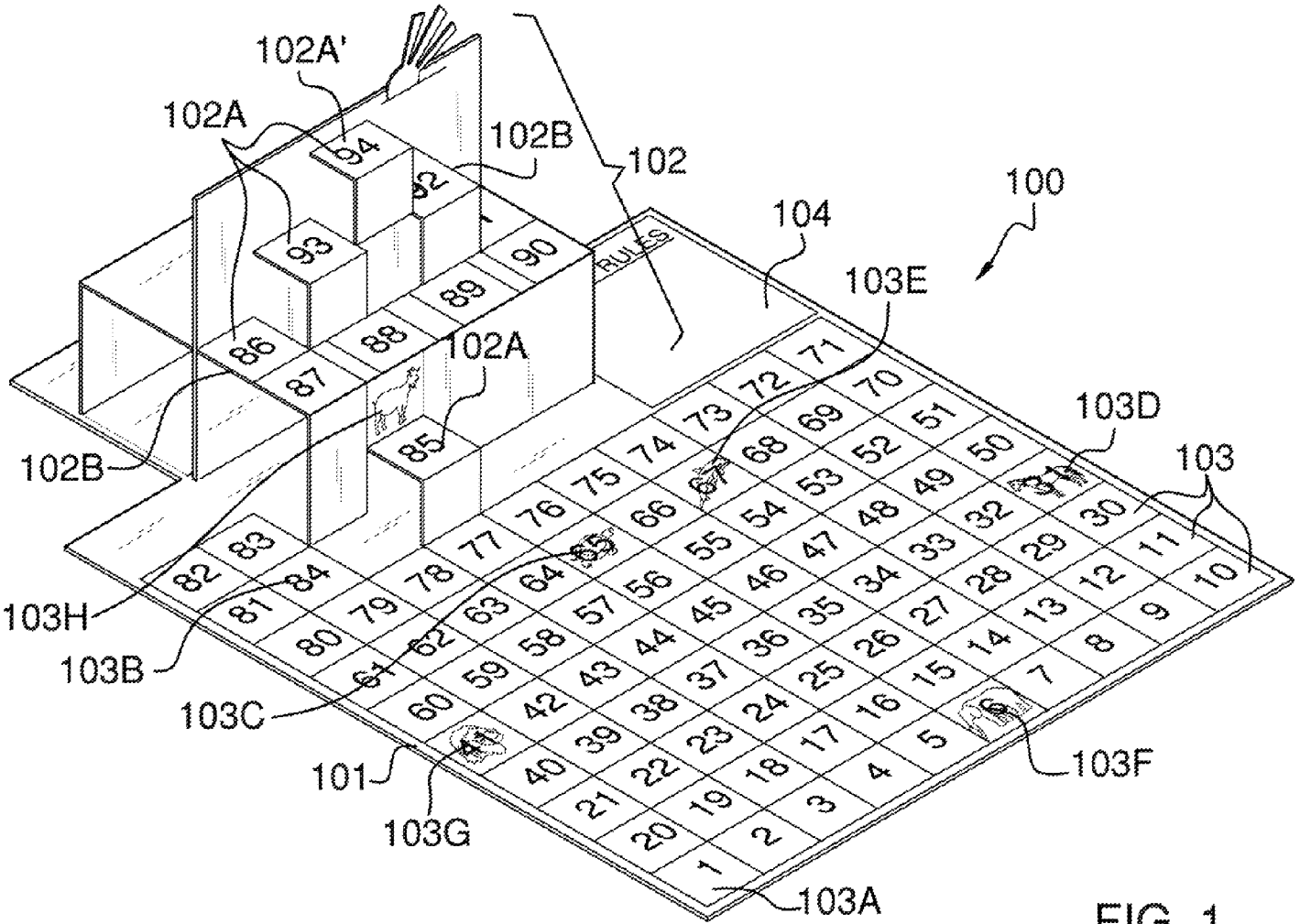
FIG. 1 illustrates a perspective view of the game board used to play the King of the Mountain board game.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous Over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A King of the Mountain board game 100 (hereinafter invention) includes a game board 101 that includes a mountain 102 thereon. The game board 101 is a flat surface having a plurality of differently numbered squares 103 along a portion of the overall surface of the game board 101. The differently numbered squares 103 start out with a "1" square 103A and follow along a path in numerical order up and until an "84" square 103B.

As previously mentioned, the objective of the game is to be the first player to traverse along the differently numbered squares 103, and ascend to the top of the mountain 102, and according to the rules of play.

The mountain 102 includes differently numbered squares 102A that are located at varying tiers 102B. The mountain 102 is capable of folding flat when the invention 100 is no longer in use (see FIG. 4). The construction of the game board 101 and the mountain 102 is made of a material comprising a cardboard, plastic, or reinforced paper of suitable weight and durability.

The game board 101 includes a game rule card 104, which is provided on a small portion of the flat surface of the game board 101. The game rule card 104 dictates how the game is to be played, and more particularly, the rules governing dice 105 provided with the invention 100.

Figure 2:
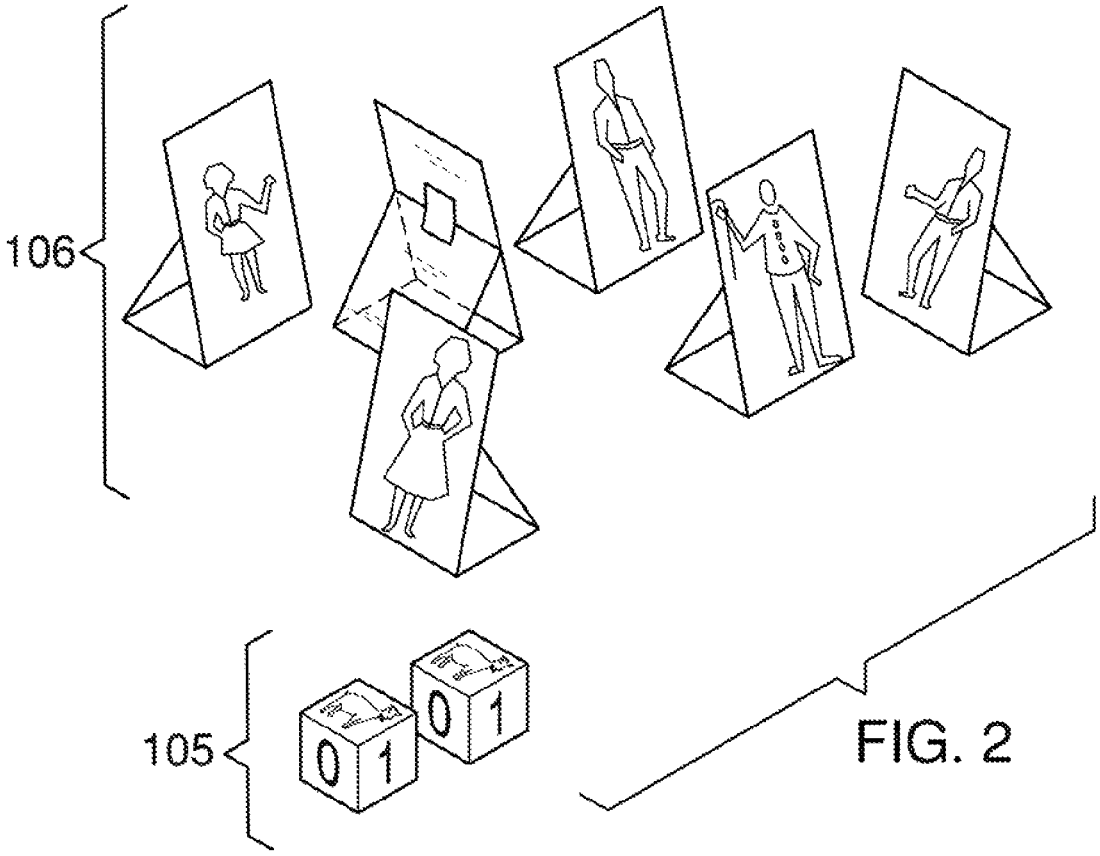
FIG. 2 illustrates a view of the dice and playing pieces.
Figure 2A:
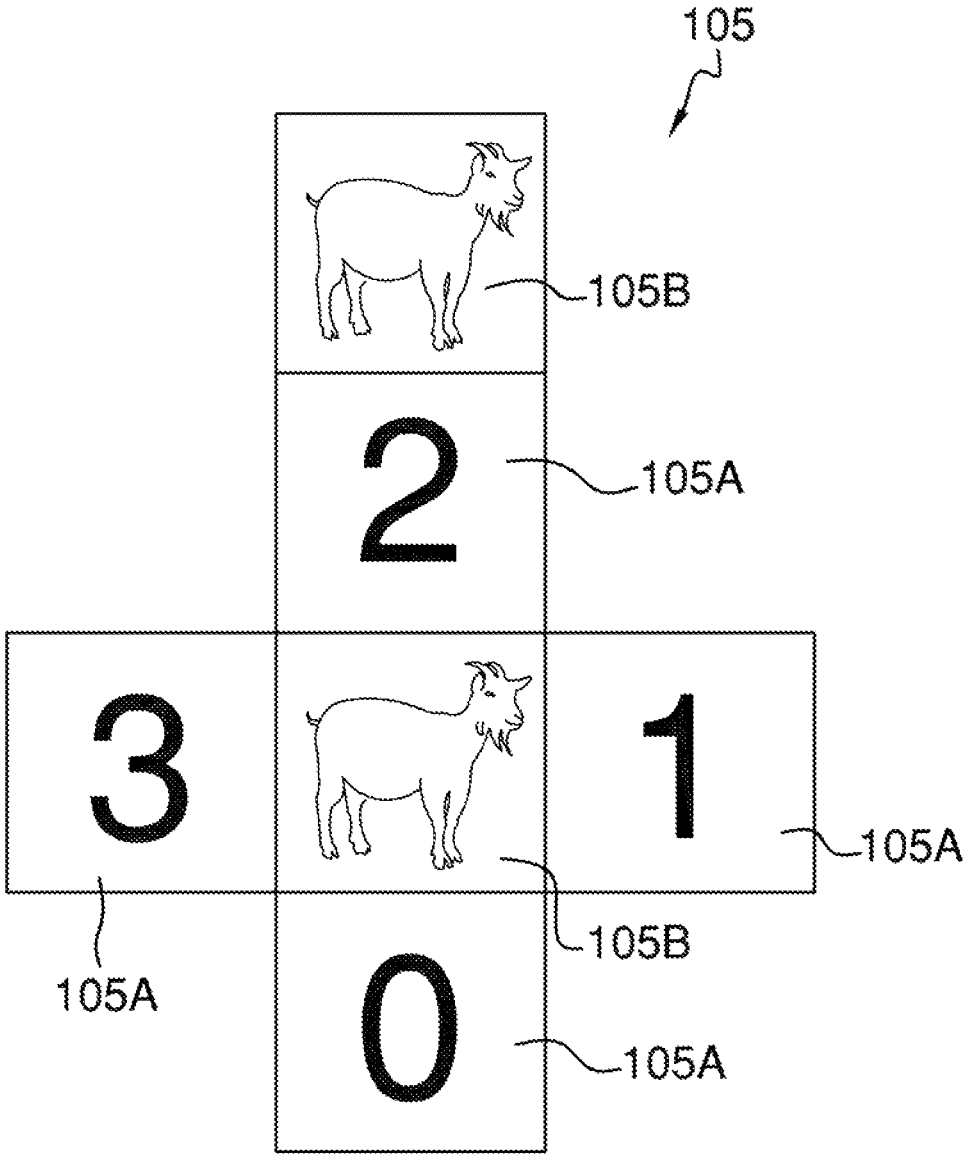
FIG. 2A illustrates a view of the dice folded out to show the various numbers and Billy goat surfaces provided thereon.
Figure 3:
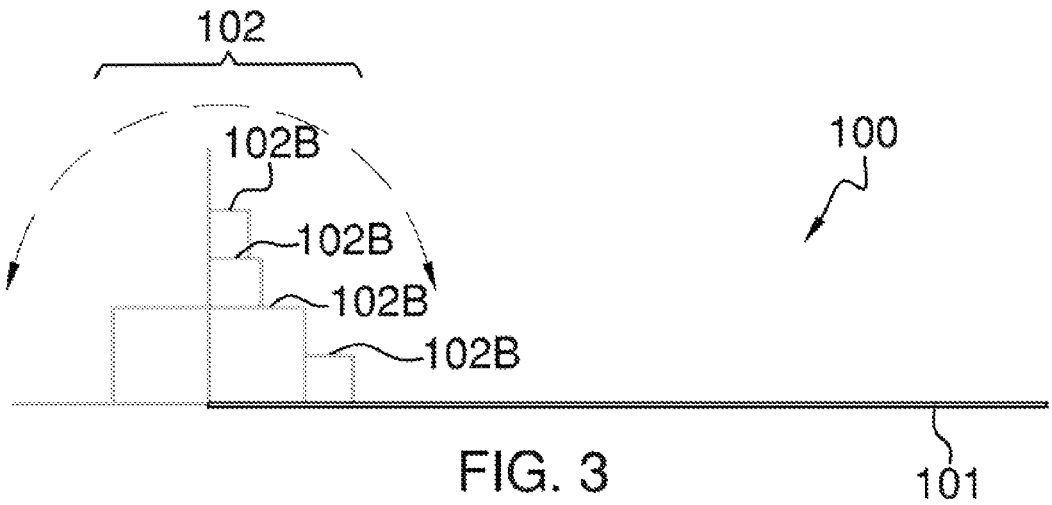
FIG. 3 illustrates a side view of the King of the Mountain board game by itself and in an erected position for use when playing the game.
Figure 4:
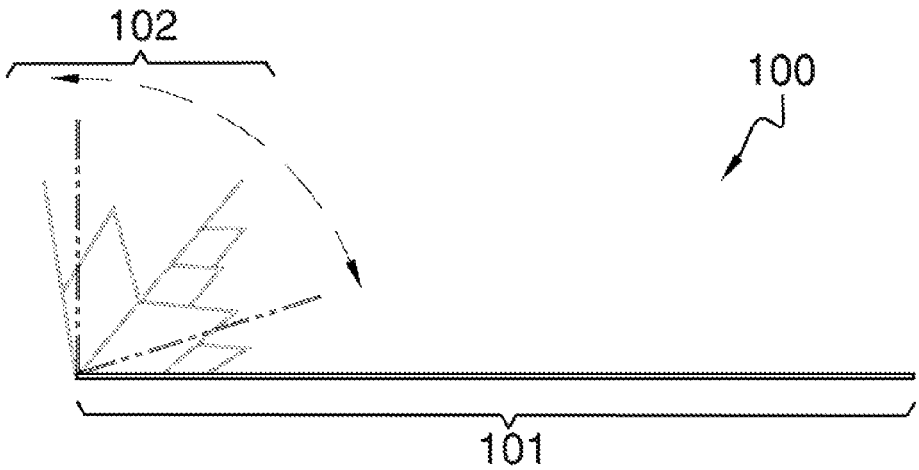
FIG. 4 illustrates a side view that details how the mountain portion of the board game can collapse when no longer in use.

The dice 105 are folded flat in FIG. 2A, and includes different numbers 105A and Billy Goats 105B on different surfaces of the dice 105. The numbers 105A and the Billy Goats 105B, when rolled, shall proscribe the movement of a player's piece 106 along the differently numbered squares 103A and 102A of the game board 101 and the mountain 102, respectively.

Referring to FIG. 5, the game rule card 104 lists the particular moves generated upon rolling the dice 105.

Each player selects one of the player's pieces 106, and shall begin at the "1" square 103A, and shall play according to the game rule card 104. The game rule card 104 states that the objective of the game is to be the first one to make it to the top of the mountain, which means that the respective player's piece 106 shall land on a top square 102A' of the differently numbered square 102A of the mountain 102. More specifically, the top square 102A' is numbered "94", but may be a different number in that the invention 100 may have a game board 101 and mountain 102 with more or less than 94 total squares.

The game rule card 104 also delineates the course of action when a player rolls the dice 105, and rolls on a square with an animal thereon. Referring to FIG. 1, the game board 101 includes a turtle square 1030 with a "turtle" on the square 103 numbered "65." When the player's piece 106 lands on the turtle square 103C, the respective player's piece 106 shall move back to the square 103 with the number "62" thereon.

The game board 101 also has a horse square 103D with a "horse" on the square 103 numbered "31." When the player's piece 106 lands on the horse square 103D, the respective player's piece 106 shall move forward to the square 103 numbered "38."

The game board 101 also has a dolphin square 103E with a "dolphin" on the square 103 numbered "67." When the player's piece 106 lands on the dolphin square 103E, the respective player's piece 106 shall move forward to the square 103 numbered "76."

The game board 101 also has an elephant square 103F with an "elephant" on the square 103 numbered "6." When the player's piece 106 lands on the elephant square 103F, the respective player's piece 106 shall move forward to the square 103, numbered "18."

The game board 101 also has a lion square 103G with a "lion" on the square 103 numbered "41." When the player's piece 106 lands on the lion square 103G, the respective player's piece 106 shall move back to the square 103 numbered "27."

The game board 101 also has a Billy goat square 103H with a "Billy goat" on a surface adjacent to the numbered square 102A numbered "85." Should the player's piece 106 land on the numbered square 102A with the number "85", the player shall roll the dice 105 again.

Furthermore, the game rule card 104 delineates the course of action when the player rolls numbers 105A or two Billy goats 105B. In particular, the game rule card 104 provides the ruling for rolling two Billy goats via the dice 105.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A King of the Mountain board game comprising:

at game board having a mountain provided on a portion of said game board;

wherein both the game board and the mountain are provided with a plurality of differently numbered squares that are consecutively arranged to form a path along which a players piece shall travel according to rules of play;

wherein at least two dice are included and upon rolling shall direct a player's move according to rules of play;

wherein the objective is to be the first player to traverse the path and ascend to the too of the mountain;

wherein the dice each have at least one side having a number and at least one side having a Billy Goat image;

wherein the mountain can fold flat when not in use;

wherein the differently numbered squares are located at varying tiers such that the game board has varying elevations that form the mountain;

wherein the game board includes a "1" square;

wherein the game board has a plurality of differently numbered squares on a horizontal level surface beginning with the "1" square, and ending at an "84" square;

wherein a vertical mountain portion having multiple horizontal tiers in said game board begins with a numbered square with an "85" and ends with a numbered square with "94".

2. The King of the Mountain board game as described in claim 1 wherein a game rule card, which is provided on a small portion of the flat surface of the game board, and wherein the game rule card dictates how the game is to be played, and more particularly, the rules governing dice provided therein; wherein each player selects one of the player's pieces, and shall begin at the "1" square, and shall play according to the game rule card.

3. The King of the Mountain board game as described in claim 2 wherein if a player's piece lands on a turtle square, the respective player's piece shall move back to the numbered square with "62."

4. The King of the Mountain board game as described in claim 3 wherein the turtle square is numbered square "65."

5. The King of the Mountain board game as described in claim 2 wherein if a player's piece lands on a horse square, said player's piece shall move forward to the numbered square with "38."

6. The King of the Mountain board game as described in claim 5 wherein the horse square is numbered square "31."

7. The King of the Mountain board game as described in claim 2 wherein if a player's piece lands in a dolphin square, said player's piece shall move forward to the numbered square with "76."

8. The King of the Mountain board game as described in claim 7 wherein the dolphin square is numbered square "67."

9. The King of the Mountain board game as described in claim 2 wherein if a player's piece lands on an elephant square, said player's piece shall move forward to the numbered square with "18."

10. The King of the Mountain board game as described in claim 9 wherein the elephant square is numbered square "6."

11. The King of the Mountain board game as described in claim 2 wherein if player's piece lands en a lion square, said player's piece shall move back to the numbered square with "27."

12. The King of the Mountain board game as described in claim 11 wherein the lion square is numbered square "41."

13. The King of the Mountain board game as described in claim 2 wherein if a player's piece lands on a numbered square with a Billy goat on an adjacent surface, then said player shall roll the dice again.

14. The King of the Mountain board game as described in claim 13 wherein the numbered square is numbered square "85."

* * * * *

UNITED STATES PATENT AND TRADEMARK OFFICE

CERTIFICATE OF CORRECTION

PATENT NO. : 8,419,017 B1
APPLICATION NO. : 13/372548
DATED : April 16, 2013
INVENTOR(S) : Joel E. Lazare It is certified that error appears in the above-identified patent and that said Letters Patent is hereby corrected as shown below:

In the Specification

On column 2, line 32 includes a forward slash between the words “to” and “traverse” that needs to be removed.

In the Claims

On column 5, line 51, The word “too” should be replaced with the word “top”.

Signed and Sealed this
Eighteenth Day of June, 2013

Teresa Stanek Rea
*Acting Director of the United States Patent and Trademark Office*